US005402836A

United States Patent [19]

Hasper et al.

[11] Patent Number: 5,402,836

[45] Date of Patent: Apr. 4, 1995

[54] VALVE ASSEMBLY FOR A BOTTLE USED IN A LIQUID DISPENSING APPARATUS

[76] Inventors: Pat K. Hasper; Wolfgang A. Hasper, both of 6060 Miller Landing Cove, Talahassee, Fla. 32312

[21] Appl. No.: 216,502

[22] Filed: Mar. 23, 1994

[51] Int. Cl.[6] ..... B67C 3/00

[52] U.S. Cl. ..... 141/364; 141/346; 141/319; 141/349; 222/561

[58] Field of Search ..... 141/319, 320, 321, 322, 141/363, 364, 375, 351, 352, 353, 356, 357, 349; 222/561, 559, 562, 567

[56] References Cited

U.S. PATENT DOCUMENTS

| | | | |
|---|---|---|---|
| 2,699,885 | 1/1955 | McClure | 141/320 |
| 4,391,308 | 7/1983 | Steiner | 141/364 X |
| 4,421,146 | 12/1983 | Bond et al. | 141/349 |
| 4,445,551 | 5/1984 | Bond et al. | 141/349 |
| 4,874,023 | 10/1989 | Ulm | 141/349 X |
| 4,903,742 | 2/1990 | Gagnon | 141/353 |
| 5,095,962 | 3/1992 | Lloyd-Davies | 141/246 |
| 5,121,778 | 6/1992 | Baker et al. | 141/319 |
| 5,316,058 | 5/1994 | Spektor et al. | 141/319 |

FOREIGN PATENT DOCUMENTS

| | | | |
|---|---|---|---|
| 325240 | 2/1930 | United Kingdom | 141/351 |

*Primary Examiner*—Ernest G. Cusick

*Attorney, Agent, or Firm*—Carnes, Cona, Dixon

[57] ABSTRACT

The present invention provides for a valve assembly to include a cap which is removably secured to a spout of a water bottle. The cap further includes an aperture for receiving a hollow shank having an opened top and an opened bottom. A shaft is received in the opened bottom of the shank for permitting the shaft to slide freely and vertically within the shank. The shaft further includes at least one hole encompassing the side wall of the top area and a stop extending outwardly from an enclosed top. This stop contacts the opened top of the shank to maintain for the assembly to be in a closed position, accordingly, providing the hole to be covered by the shank. Located at the bottom of the shank is a first flange and located at the bottom of the shaft is a second flange. A locking ring is releasably attached to the shaft for maintaining the valve assembly to be in a closed position. In order to activate the valve assembly, the cap is attached to the spout of a bottle. The bottle is inverted onto the liquid dispensing device and the locking ring is released. This cause the shaft to move upward and extend beyond the open top of shank and exposes the hole, allowing the liquid to flow from the bottle and into the liquid dispensing apparatus. The movement of the shaft is stopped once the second flange on the shaft contacts the first flange of shank.

5 Claims, 2 Drawing Sheets

VALVE ASSEMBLY FOR A BOTTLE USED IN A LIQUID DISPENSING APPARATUS

BACKGROUND OF THE INVENTION

Bottled water is used in many situations. There are many areas, both in the United States and abroad, where the tap water is unfit for human consumption. In these areas the use of bottled water is a necessity. Even in areas where the tap is safe to consume, many people perceive a health benefit to the use of bottled water.

In the event of an industrial accident, people close to the accident site must turn to bottled water. With their regular drinking water source contaminated, bottled water for these people is a must. A similar situation arises when a natural disaster, such as an earthquake or a flood, knocks out the pumping station or water main.

The containers used to hold bottled water come in many sizes. A very popular container is the five gallon vessel. These five gallon bottles are found in small offices and businesses where a water fountain is not feasible. These bottles are also found in homes where the use of bottled water is significant.

In order to retrieve water from these five gallon bottles, a dispenser is typically used. The bottle is placed upside down, relative to the bottle's spout, into a receiving chamber within the dispenser. Once so placed, water can be liberated by the use of some faucet means. These bottle and dispenser means are a low cost and efficient way to dispense bottled water.

The above dispensing system is not without problems. In order to load a full bottle into the dispensing unit, one of two methods is typically employed.

A person can remove the bottle cap and then quickly turn the bottle upside down and insert the bottle into the dispensing unit. As the five gallon bottle weighs in excess of forty pounds, such a feat can prove dangerous. Quickly maneuvering such a heavy load can cause back strain or even a dropped bottle. Furthermore, such a maneuver will cause some of the water to spill either onto the person loading the bottle or onto the floor. The above results are all undesirable.

The second loading method is to, turn the bottle upside down and place the spout close to the dispensing unit. At that point, the bottle cap is removed and the bottle is lowered the final few inches into the dispenser. This method eliminates the hazards associated with a spill. However, if this method is being attempted by one person, that person must hold the bottle with one hand when removing the cap. Even a person of superior size and strength will find it difficult to hold such a large and heavy item with one hand. The potential for serious injury is strong.

What is needed is a bottle valve assembly whereby the bottle can be placed into the dispensing unit without water spill potential. Such an assembly must keep the bottle closed until it is safely secured in the dispensing unit. Once so secured, the valve will go into an open position permitting water flow.. Ideally such a cap should be inexpensive, easy to use, and reusable.

SUMMARY OF THE INVENTION

The present invention provides for a valve assembly that can be used with a liquid dispensing apparatus. The invention is releasably attachable to the spout of a water bottle and keeps the bottle in a closed position until it is safely secured in a dispensing unit. The valve assembly of the present invention includes a cap, shank, and shaft.

The cap includes a top and an encompassing side wall which, when combined, fit securely onto the spout. Centrally located on the cap is an aperture. This aperture receives the shank.

The shank is a hollow tube. The shank has an open bottom and an open top. The bottom of the shank receives the shaft. The shaft is able to slide freely and axially about the interior of the shank. The shaft includes a plurality of holes, which when exposed, provides for the valve assembly to be in an open position.

Once the valve assembly is releasably attached to the spout of the bottle in the closed position, the bottle is inverted onto the liquid dispensing apparatus. The interior configuration and design of the liquid dispensing apparatus causes the shaft to move upward thereby opening the valve assembly. This permits the liquid in the bottle to flow into the liquid dispensing apparatus.

Therefore, it is the object of the present invention to provide for a valve assembly that eliminates the difficulties of installing a bottle onto a liquid dispensing apparatus.

It is another object of the present invention to provide for a valve assembly that is easy to use.

It is another object of the present invention to provide for a valve assembly that can be utilized from one bottle to the next.

It is a final object of the present invention to provide for a valve assembly that is durable in operation and inexpensive to fabricate.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
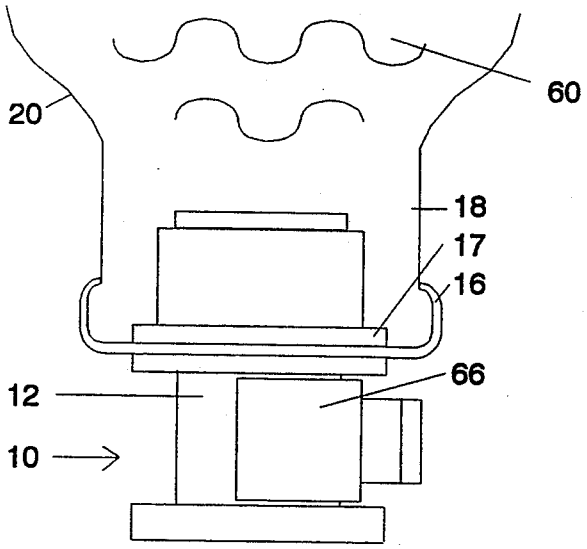
FIG. 1 is a side elevational view of the valve assembly of the present invention in a closed sealed position releasably attached to a bottle used in a liquid dispensing apparatus.
Figure 2:
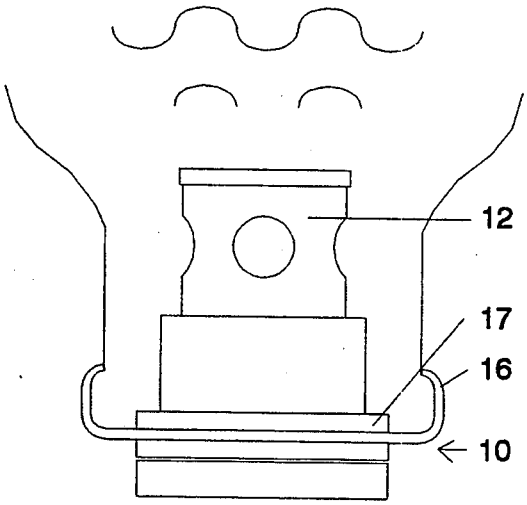
FIG. 2 is a side elevational view of the valve assembly of the present invention in an open position.
Figure 6:
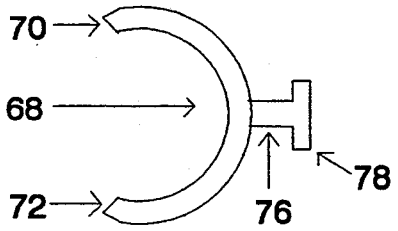
FIG. 6 is a detailed perspective view of a locking ring of the present invention.

FIGS. 1 and 2 illustrate the various views of the valve assembly of the present invention. As seen in these figures the valve assembly 10 consists of a shaft 12, shank 14, and cap 16. As these figures illustrate, the cap 16 is releasably attachable to a spout 18 of a liquid bottle 20 (such as a five or six gallon water bottle) which is used in a liquid dispensing apparatus. When the device is in a closed sealed position the liquid 60 within the liquid bottle cannot flow. Once the valve assembly is activated and placed in an open position, liquid can flow freely into the liquid dispensing apparatus (illustrated in further detail in FIGS. 6A and 6B).

Figure 3A:
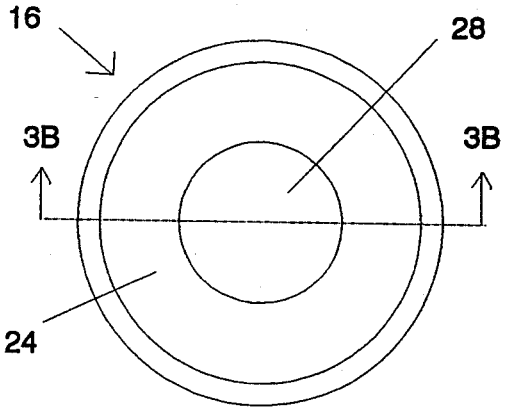
FIG. 3A is a detailed top planar view of the cap used in the valve assembly of the present invention.
Figure 3B:
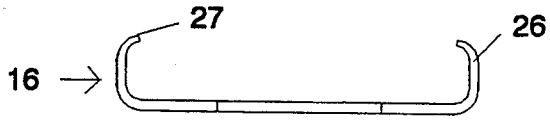
FIG. 3B is a detailed cross sectional view of the cap used in the valve assembly of the present invention taken along line 3B—3B of FIG. 3A.

The cap is illustrated in further detail in FIGS. 3A and 3B. As seen, the cap 16 consists of a top 24 and an encompassing side wall 26. Located within the cap is an O-ring 17 used to provide a proper seal when the cap is attached to a bottle. Located on the top of the side wall is an inwardly curved peripheral end portion 27. This end portion 27 and the side wall of the cap provide for a snug, secure, and releasably attachable fit on the spout of a conventional liquid bottle (illustrated in FIGS. 1 and 3). Centrally located on the top of the cap is an aperture 28. This aperture receives the shank, which is illustrated in further detail in FIGS. 5A and 5B. The top, encompassing side wall, and inwardly curved peripheral end portion of the cap form an integral object and can be made out of any durable and resilient material such as rubber or plastic.

Figure 4A:
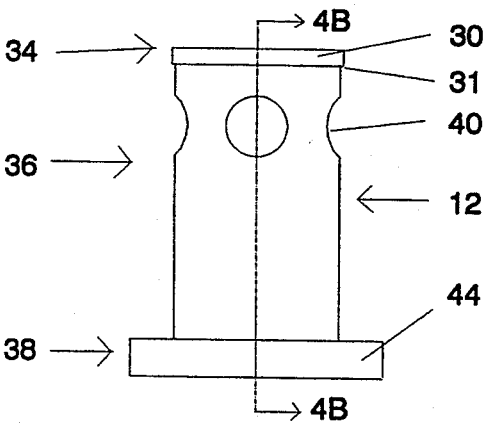
FIG. 4A is a detailed side elevational view of the shaft used in the valve assembly of the present invention.
Figure 4B:
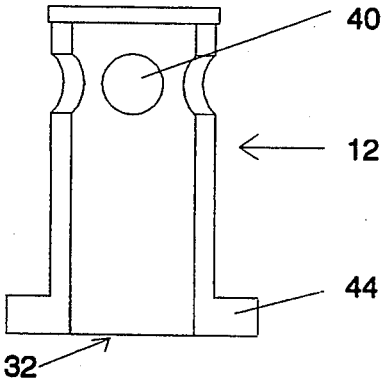
FIG. 4B is a detailed cross sectional view of the shaft used in the valve assembly of the present invention taken along line 4B—4B of FIG. 4A.

The shaft 12 is illustrated in further detail in FIGS. FIG. 4A and 4B. As seen in these figures, the shaft 12 is an elongated cylindrical hollow tube having an enclosed top and an open bottom 32. The shaft further includes a top area 34, a middle area. 36, and a bottom area 38. Located on the top is a stopper cap 31. The stopper cap has a diameter greater than that of the shank 14 (discussed below). Encompassing the top area of the shaft is a plurality of holes 40. These holes allow the liquid from the liquid dispensing device to flow once the valve assembly is in an open position. Attached to the bottom area of the shaft is a flange 44. This flange is maintained in a secured position against the shank once the valve assembly is opened. The flange is an integral object that is constructed from any durable and sturdy material such as polyvinyl chloride (PVC).

Figure 5A:
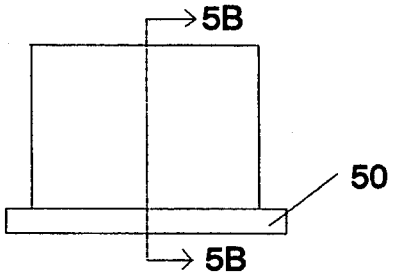
FIG. 5A is a detailed side elevational view of the shank used in the valve assembly of the present invention.
Figure 5B:
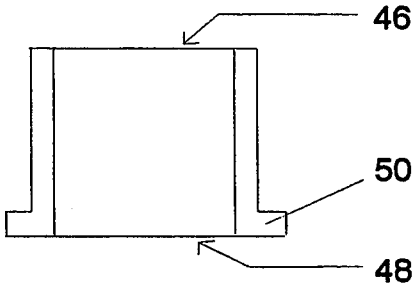
FIG. 5B is a detailed cross sectional view of the shank used in the valve assembly of the present invention taken along line 5B—5B of FIG. 5A.

The shank 14 is illustrated in detail in FIGS. 5A and 5B. This shank 14 is a hollow tube which has an open top 46 and an open bottom 48. The shaft is received in the open bottom of the shank and passes and extends from the open top (illustrated in FIGS. 1 and 2). Located at bottom of the shank is a flange 50. This flange 50 of the shank rests on the flange 44 of the shaft (illustrated in FIG. 2) when the valve assembly is in an open position. The shank is an integral object and is fabricated from any durable and sturdy material, such as polyvinyl chloride (PVC).

The shaft slides freely within the shank. The stopper cap 31 prevents the shaft from sliding out of the shank.

When the valve assembly is in a closed position, the shaft 12 is extended outwardly from the shank 14 until the stopper cap 31 contacts the top end 46 of the shank preventing further outward extension of the shaft 12. In such a position, the plurality of holes 40 on the shaft is covered by the shank 14. As the shaft 12 has an enclosed top, liquid will be prevented from flowing through the shaft.

In order to place the valve assembly into an open position, the shaft's flange 44 is slid upwardly toward the shank 14 so that the shaft's top area 34 extends outwardly from the shank's top end 46. When the flange 44 of the shaft contacts the flange 50 of the shank, further upward sliding is terminated. The top area's 34 outward extension from the top end 46 causes the plurality of holes 40 to be exposed. Liquid can now flow into the plurality of holes 40 and through the open bottom 32 of the shaft 12, thereby being liberated from the bottle.

An optional locking ring 66 may be releasably attached to the shaft to ensure that the valve assembly is maintained in a closed position during shipping and storage. This optional locking ring is removed prior to placing the bottle onto the liquid dispensing apparatus. The optional locking ring is illustrated in further detail in FIG. 6.

The locking ring 66 maintains the flange from the shank from contacting the flange from the shaft in order to maintain the valve assembly to be in a closed position. The locking ring has a unique shape and configuration and is attached snugly to the shaft. This locking ring is shaped somewhat like the letter omega. The locking ring has a curved body 68 which fits and conforms around the shaft. The curved body has a first end 70 and a second end 72. An extension 76 is centrally located on the outer circumference of the curved body. Attached to the end of the extension is a grasper 78. This grasper permits a person to easily grasp the locking ring and remove it from the shaft.

Figure 7A:
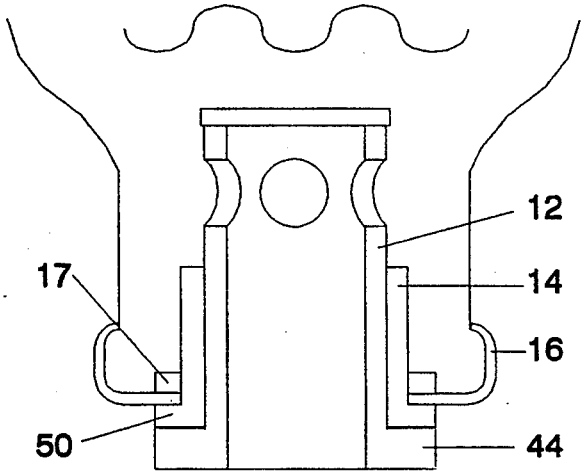
FIG. 7A is a detailed cross sectional view of the valve assembly of FIG. 2 in an open position on an inverted bottle within the inner container of a liquid dispensing apparatus.
Figure 7B:
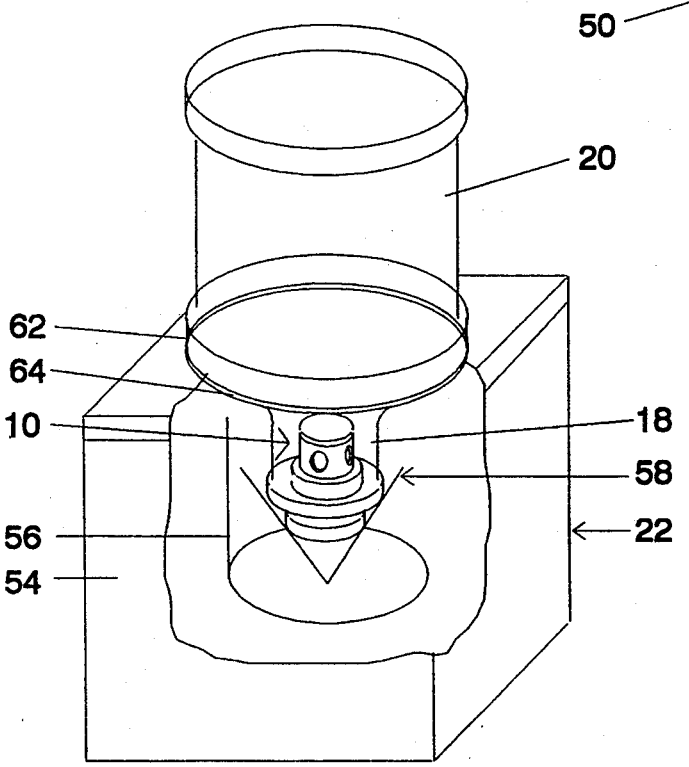
FIG. 7B is a fragmentary elevational view of the valve assembly of the present invention attached to a bottle inverted on a container within a liquid dispensing apparatus.

FIGS. 7A and 7B illustrate the utilization of the water valve assembly with the conventional liquid dispensing apparatus. As illustrated, a conventional liquid dispensing apparatus 22 includes an outer free standing cabinet 54. Located within the free standing cabinet is a liquid holding container 56 having a funnel-like receiving portion 58. This receiving portion actuates the valve assembly 10 of the present invention. The top of the cabinet includes an opening which receives the bottle 20. A bottle shoulder located on the bottle 20 will rest upon an upper cabinet ring 64. The combination of the bottle shoulder and cabinet ring maintains and secures the bottle on the liquid dispensing apparatus. A spout (not illustrated) extends from the liquid holding container to the outer surface of the cabinet in order to allow an individual to use and obtain the liquid from the apparatus.

The conventional bottle 20 which is used in combination with the liquid dispensing apparatus is further provided with a protective cap (not illustrated). This protective cap is removed and the valve assembly of the present invention is placed on the spout 18 of the bottle 20 prior to placing it on the liquid dispensing apparatus. The valve assembly is placed on the bottle in a closed position (not illustrated). This provides that the plurality of holes located in the shaft remain covered by the shank.

Once the valve assembly is releasably attached to the bottle spout 18, the locking ring is removed. The bottle is then inverted and is placed in the opening of the cabinet. The opening receives the valve assembly 10 and the spout 18 of the bottle.

The flange 44 of the shaft is received in the funnel-like receiving portion 58 of the liquid dispensing apparatus. Once the flange 44 of the shaft communicates with the funnel-like receiving portion the flange 44 slides upward.

The upward sliding renders the Valve assembly into an open position. This provides for the liquid 60 located in the bottle to flow freely into the container 56 of the liquid dispensing apparatus.

Gravity will allow the liquid to flow from the bottle into the container. The liquid will continue to flow until the liquid level rises to the cap of the valve assembly. This will eliminate air flow to the bottle's interior and will cease liquid flow.

While the invention has been particularly shown and described with reference to an embodiment thereof, it will be understood by those skilled in the art that various changes in form and detail may be made without departing from the spirit and scope of the invention.

I claim:

1. A liquid container having a spout and containing a liquid which is used in a liquid dispensing apparatus in combination with a valve assembly, said valve assembly comprising:

a cap, a shaft, and a shank;

said cap has a top and an encompassing side wall for permitting said valve assembly to be removably secured to said spout;

said top of said cap has an opening for receiving said shank;

said shank has a hollow interior, an opened top and an opened bottom;

said shaft is hollow and has an opened bottom end;

a stopper cap is located on said shaft for providing said shaft to have an enclosed top end;

said shaft further includes a top area, a middle area, and a bottom area;

said top area includes at least one opening for urging flow of said liquid when said valve assembly is in an opened position;

said bottom area includes said opened bottom end and a first flange;

said first flange is peripherally aligned with said opened bottom end and extends perpendicularly from said shaft;

said shaft is located within said hollow interior of said shank for permitting said shaft to move axially within said shank;

said stopper cap extends perpendicularly beyond said shaft for terminating downward axial movement of said shaft when said stopper cap contacts said opened top of said shank for providing said valve assembly to be in a closed position by rendering said shank to cover said at least one opening; and said shank includes a second flange contacting said top of said cap and peripherally aligned with said opened bottom of said shank and extending perpendicularly from said opened bottom for terminating upward axial movement of said shaft when said first flange is communicating with said second flange for providing said valve assembly to be in an opened position by rendering said top area of said shaft to extend beyond said opened top of said shank and to provide for said at least one opening to be exposed.

2. The combination as in claim 1 wherein said an unbreakable locking means is releasably attached to said shaft for maintaining said valve assembly to be in said closed position.

3. The combination as in claim 2 wherein said locking means further includes a body which is shaped to correspond with said shaft having a first end, a second end, and an opening therebetween for receiving and releasing said shaft.

4. The combination as in claim 3 wherein an extension is centrally attached to said body and extends perpendicularly from said body, and said extension acts as a grasper for removing from and attaching to said locking means from said shaft.

5. The combination as in claim 4 wherein said shaft and said shank each have a cylindrical shape.

* * * * *